US006957782B2

(12) United States Patent
Clark et al.

(10) Patent No.: US 6,957,782 B2
(45) Date of Patent: Oct. 25, 2005

(54) IRRIGATION SPRAY NOZZLE WITH TWO-PIECE COLOR IDENTIFIER AND RADIALLY SHAPED ORIFICE

(75) Inventors: Michael L. Clark, San Marcos, CA (US); Kenneth C. Roper, Escondido, CA (US); Nathan T. Garcia, Vista, CA (US)

(73) Assignee: Hunter Industries, Inc., San Marcos, CA (US)

( * ) Notice: Subject to any disclaimer, the term of this patent is extended or adjusted under 35 U.S.C. 154(b) by 42 days.

(21) Appl. No.: 10/654,250

(22) Filed: Sep. 2, 2003

(65) Prior Publication Data

US 2005/0045737 A1 Mar. 3, 2005

(51) Int. Cl.[7] ..... B67D 5/08
(52) U.S. Cl. ..... 239/200; 71/73; 71/204
(58) Field of Search ..... 239/200, 71, 73, 239/74, 201, 203, 204, 205, 104, 288, 288.3, 288.5, 461, 465, 523; 116/200

(56) References Cited

U.S. PATENT DOCUMENTS

| | | | | | |
|---|---|---|---|---|---|
| 4,189,099 | A | | 2/1980 | Bruniga | 239/200 |
| 4,579,285 | A | | 4/1986 | Hunter | 239/457 |
| 4,739,934 | A | | 4/1988 | Gewelber | 239/446 |
| 4,913,352 | A | | 4/1990 | Witty | 239/104 |
| 4,939,797 | A | * | 7/1990 | Goettl | 4/490 |
| 5,050,800 | A | * | 9/1991 | Lamar | 239/201 |
| 5,524,824 | A | * | 6/1996 | Frimmer | 239/71 |
| 5,642,861 | A | * | 7/1997 | Ogi et al. | 239/568 |
| 5,779,148 | A | | 7/1998 | Saarem et al. | 239/104 |
| 6,145,758 | A | * | 11/2000 | Ogi et al. | 239/457 |
| 6,158,675 | A | | 12/2000 | Ogi | 239/396 |
| 6,488,218 | B1 | * | 12/2002 | Townsend et al. | 239/205 |
| 6,530,531 | B2 | * | 3/2003 | Butler | 239/205 |
| 6,622,933 | B1 | * | 9/2003 | Young et al. | 239/66 |

* cited by examiner

*Primary Examiner*—David A. Scherbel
*Assistant Examiner*—Seth Barney
(74) *Attorney, Agent, or Firm*—Michael H. Jester

(57) ABSTRACT

An exterior portion of the nozzle with a top side viewable from above the turf or ground surface mates with a base portion of the nozzle to define a nozzle orifice and a flow path leading to the nozzle orifice. The base portion has at least one projection that extends through an aperture in the exterior portion and provides an indication that is visible when viewing the top side and that represents a water distribution pattern and/or flow rate of the nozzle orifice. The exterior portion of the nozzle defines an inner arc section of the nozzle orifice and the base portion of the nozzle defines an outer arc section of the nozzle orifice that is radially spaced from the inner arc section. An improved water distribution pattern is achieved without the spikes and voids associated with conventional spray nozzle orifices.

11 Claims, 5 Drawing Sheets

IRRIGATION SPRAY NOZZLE WITH TWO-PIECE COLOR IDENTIFIER AND RADIALLY SHAPED ORIFICE

FIELD OF THE INVENTION

The present invention relates to sprinklers used to water turf and other landscaping, and more particularly, to nozzles used in such sprinklers that disperse water relatively short distances in a fan-shaped water distribution pattern.

BACKGROUND OF THE INVENTION

Many parts of the world have inadequate rainfall at different times of the year sufficient to sustain non-native vegetation, such as lawns, playing fields, golf course, flowers, shrubs and other ground cover. Irrigation systems have been extensively developed that include a plurality of sprinklers connected to pressurized water supply lines and solenoid actuated valves. An electronic controller automatically turns the valves ON and OFF in accordance with the run and cycle times of a watering program to provide vegetation in different zones of the sprinkler system with the desired amount of precipitation. A wide variety of sprinklers have been developed for use in such systems, including drip, bubbler, impact drive, spray, rotary stream, and rotor type sprinklers.

Spray type sprinklers are well known in the irrigation art and typically include a spray nozzle that is screwed to the upper end of a fixed vertical riser or a telescoping vertical riser in the case of a so-called pop-up sprinkler. The spray nozzle is usually a generally cylindrical construction made of plastic parts. Typically a fixed orifice distributes water radially in a relatively thin fan-shaped pattern to close-in vegetation, e.g. turf and shrubs located seventeen feet or less from the spray nozzle. The size of the fixed orifice is chosen to provide, for example, one-quarter, one-half and full circle arc of coverage. The size of the fixed orifice can also be selected to deliver a particular flow rate in terms of gallons per minute, although arc size largely determines flow rate. Usually the fixed orifice is sized and configured to provide matched rates of precipitation over a given sector size. For example, a one-quarter circle arc spray nozzle will typically deliver water at half the rate of a one-half circle arc spray nozzle of the same design. Conventional spray nozzles often include a small throttling screw that can be turned with a screwdriver from the top side to adjust the flow rate of the sprinkler, which can also adjust the reach or radius to some degree. Examples of conventional irrigation spray nozzles are disclosed in U.S. Pat. Nos. 4,189,099; 4,739,934; 5,642,861; and 6,158,675. Some spray type sprinklers include an internal pressure regulator as disclosed in U.S. Pat. No. 5,779,148 for example. Some spray type sprinklers include an internal debris strainer or screen as disclosed in U.S. Pat. No. 4,913,352.

U.S. Pat. No. 4,579,285 granted Apr. 1, 1986 to Edwin J. Hunter and entitled ADJUSTABLE SPRINKLER SYSTEM discloses an irrigation spray nozzle with an adjustable arc spray orifice that can be adjusted from about zero degrees to three hundred and sixty degrees. One of two opposing spiral peripheral lips can be rotated relative to the other via a top screw to change the circumferential length of the nozzle orifice formed between the two lips. The height of the upper lip relative to the lower lip can also be adjusted with the same screw in order to change the flow rate for a preselected arc of coverage. This invention alleviates the necessity of manufacturing spray nozzles with different spray patterns and it has therefore enjoyed widespread commercial success, however, it is more expensive to manufacture than conventional fixed-arc irrigation spray nozzles.

Landscape maintenance personnel, gardeners, homeowners and the like often require the ability to inspect the nozzle from the top of the sprinklers to verify or determine whether the correct nozzle is installed. Most sprinklers are installed in a subterranean manner so that their upper ends are level with the surface of the ground or turf. Nozzle inspection is easiest when it is not necessary to manually pull up the riser to see any arc size or flow rate indicators. Color indications for nozzle radius and/or flow rate are common in the irrigation industry. The color is often in the base or inner part of the sprinkler, because customers do not like to have the complete nozzle colored, preferring a less apparent black top. A less visible color marking is acceptable to most customers and can be used to facilitate top-down visual inspection. Some sprinkler nozzles use an additional part that is colored and attached to the top of the nozzle. This is costly and the part can come off. Some sprinkler nozzles have a painted surface for color identification. This is also costly and the paint can wear off the nozzle.

A common way to indicate arc size on a spray nozzle is to mold a series of radially extending ridges on the top side of the outer ring of the nozzle which extend circumferentially the same distance as the arc of the spray pattern, e.g. one-half circle. However these ridges are tiny and are made of the same black plastic as the remainder of the nozzle and are therefore extremely difficult to observe from the top side of a pop-up sprinkler.

The water distribution pattern of an irrigation spray nozzle is conventionally produced with a hole in a lower inlet part and a peg from an upper nozzle part that enters the hole. The peg has details that allow flow through the hole and out of the nozzle. An upper deflector area above the peg opening controls the water distribution. The peg opening is usually a section of a round hole or notch. The control of the pattern using a deflection of the flow is not precise and produces spikes and voids along the intended edges.

SUMMARY OF THE INVENTION

It is therefore an object of the present invention to provide a pop-up irrigation sprinkler with an improved construction that allows easier top-down visual inspection of the water distribution pattern and/or flow rate of its nozzle orifice.

It is another object of the present invention to provide an irrigation spray nozzle with an improved shape of the orifice that corresponds to the intended water distribution pattern.

It is another object of the present invention to provide a spray nozzle with both an improved construction that allows easier top-down visual inspection of the water distribution pattern and/or flow rate of its nozzle and an improved shape of the orifice that corresponds to the intended water distribution pattern.

In accordance with a first aspect of our invention, an exterior portion of an irrigation spray nozzle with a top side viewable from above the turf or ground surface mates with a base portion of the nozzle to define a nozzle orifice and a flow path leading to the nozzle orifice. The base portion has at least one projection that extends through an aperture in the exterior portion and provides an indication that is visible when viewing the top side and that represents a water distribution pattern and/or flow rate of the nozzle orifice.

According to second aspect of our invention an exterior portion of the nozzle defines either an inner arc section of the nozzle orifice or an outer arc section of the orifice. A base portion of the nozzle defines a complementary inner or outer arc section of the nozzle orifice that is radially spaced from the other arc section. An improved water distribution pattern is achieved without the spikes and voids associated with conventional spray nozzle orifices.

DESCRIPTION OF THE PREFERRED EMBODIMENT

Figure 1:
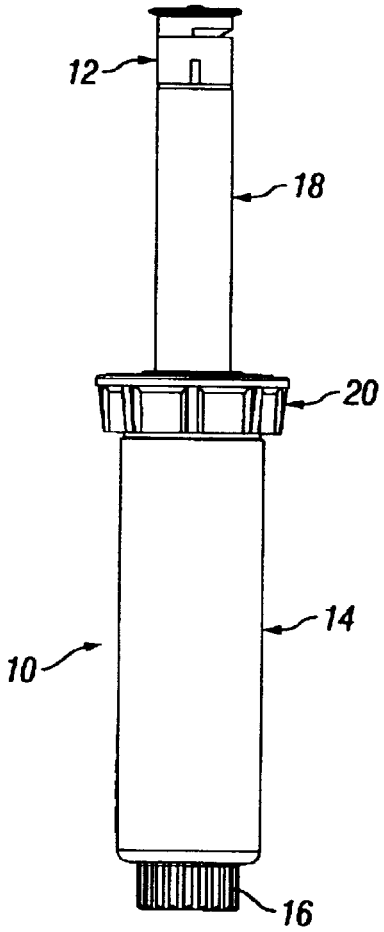
FIG. 1 is a side elevation view of a pop-up sprinkler with its riser extended and that incorporates a preferred embodiment of the spray nozzle of the present invention.
Figure 2:
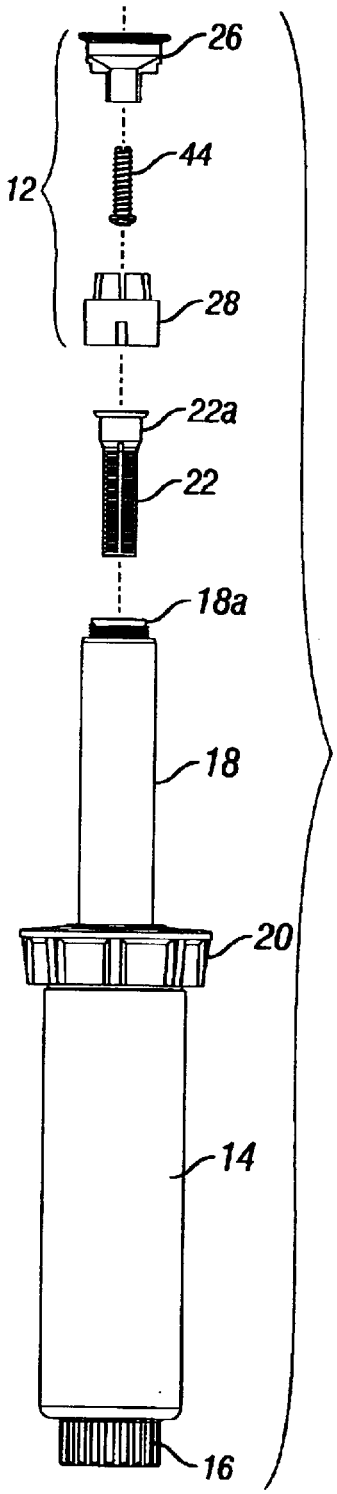
FIG. 2 is an exploded side elevation view of the pop-up sprinkler of FIG. 1.
Figure 3:
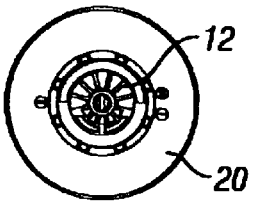
FIG. 3 is a top plan view of the sprinkler of FIG. 1.

FIGS. 1–3 illustrate a pop-up sprinkler 10 incorporating a spray nozzle 12 constructed in accordance with a preferred embodiment of the present invention. The sprinkler 10 includes a cylindrical outer housing 14 with a female threaded inlet 16 at its lower end. A tubular stem or riser 18 is mounted concentrically within the outer housing 14 for telescoping up and down movement as is well known in the art of irrigation sprinklers. The riser 18 is biased to its retracted position by a cylindrical steel coil spring (not illustrated) which surrounds the riser 18 inside the outer housing 14. The upper end of the coil spring is held in place by a female threaded cap 20 that screws over the male threaded upper end of the outer housing 14. The outer housing 14, riser 18 and cap 20 are injection molded from black colored plastic which includes a chemical additive for resisting degradation of the plastic due to ultraviolet (UV) solar radiation. The cap 20 has a central hole through which the riser 18 extends and a water tight seal between the riser 18 and the cap 20 is provided by an elastomeric white colored seal ring (not visible). A generally cylindrical perforated plastic grit strainer 22 is mounted in the upper end of the riser 18. The spray nozzle 12 screws over the male threaded upper end 18*a* (FIG. 2) of the riser 18.

Referring to FIG. 1, when a source of pressurized water coupled to the inlet 16 is turned OFF, the riser 18 is sufficiently retracted by expansion force of the previously compressed coil spring so that the top side 24 of the spray nozzle 12 is substantially even with the top side of the cap 20, which is normally very close to ground or turf level. When the source of pressurized water to the inlet 16 is turned ON, the riser 18 moves upwardly to its extended position illustrated in FIG. 1 due to the back pressure generated as a result of the relatively small fixed outlet orifice in the spray nozzle 12 hereafter described in detail. This fixed orifice distributes water radially in a relatively thin fan-shaped water distribution pattern to close-in vegetation, e.g. turf and shrubs located seventeen feet or less from the spray nozzle.

Figure 4:
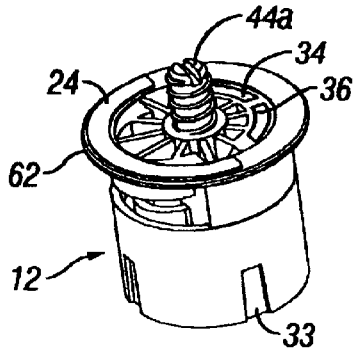
FIG. 4 is an enlarged perspective view of the preferred embodiment of our irrigation spray nozzle.
Figure 5:
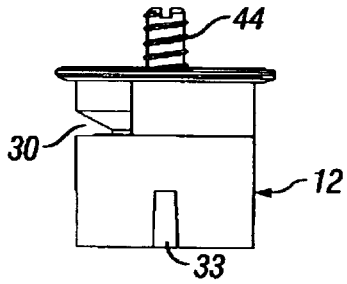
FIG. 5 is a side elevation view of the spray nozzle of FIG. 4.
Figure 6:
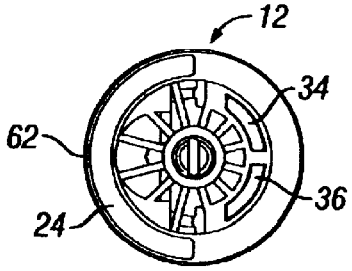
FIG. 6 is a top plan view of the spray nozzle of FIG. 4.
Figure 8:
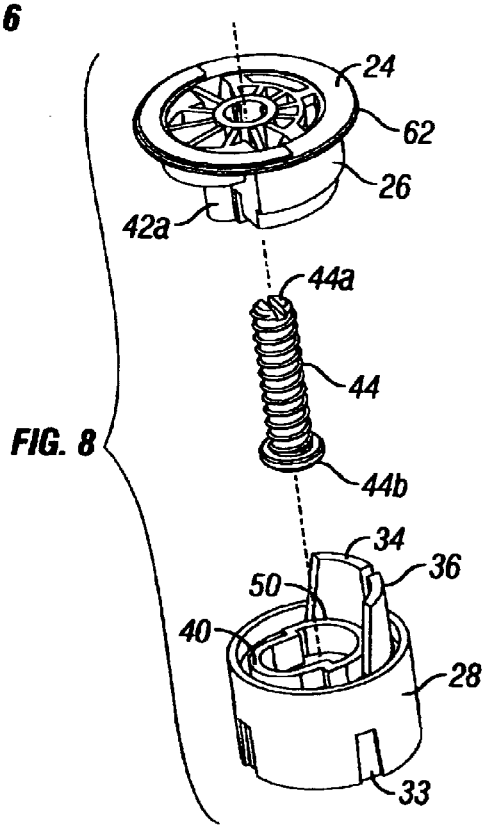
FIG. 8 is an exploded perspective view of the spray nozzle of FIG. 4.
Figure 12:
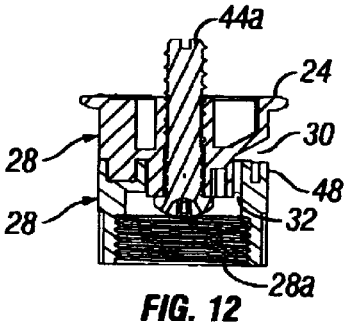
FIG. 12 is a vertical sectional view of the spray nozzle taken along line 12—12 of FIG. 11.
Figure 13:
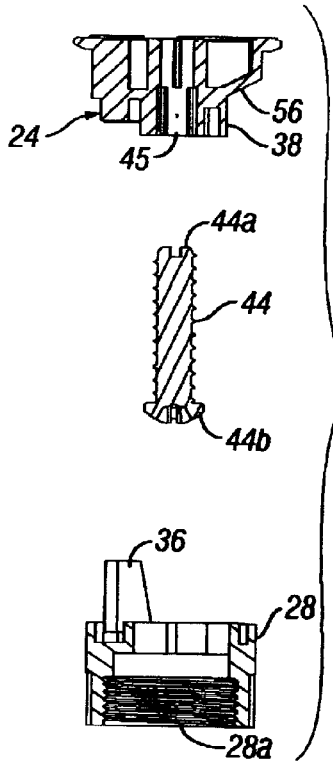
FIG. 13 is an exploded version of the vertical sectional view of the spray nozzle of FIG. 12.
Figure 14:
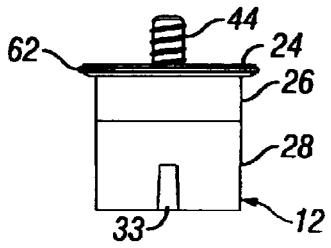
FIG. 14 is another side elevation view of the spray nozzle rotated clockwise (from above) ninety degrees about its vertical axis from its orientation illustrated in FIG. 5.
Figure 15:
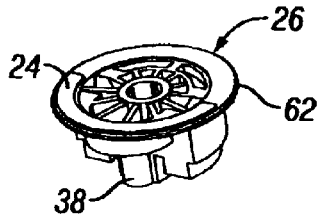
FIG. 15 is a perspective view of the exterior portion of the spray nozzle of FIG. 4.
Figure 18:
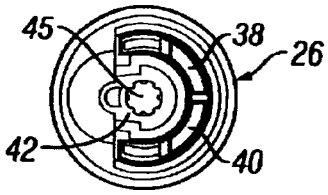
FIG. 18 is a bottom plan view of the exterior portion of the spray nozzle of FIG. 4.
Figure 21:
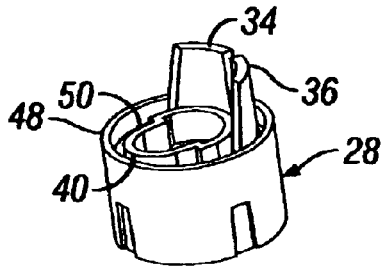
FIG. 21 is a perspective view of the base portion of the spray nozzle of FIG. 4.
Figure 22:
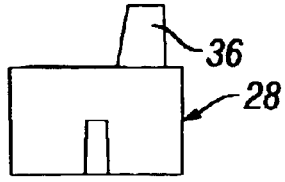
FIG. 22 is a side elevation view of the base portion of the spray nozzle of FIG. 4.
Figure 25:
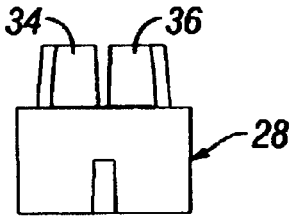
FIG. 25 is a side elevation view of the base portion of the spray nozzle of FIG. 4 rotated counter-clockwise (from above) ninety degrees about its vertical axis from its orientation illustrated in FIG. 22.
Figure 26:
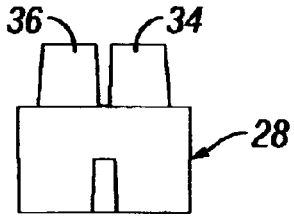
FIG. 26 is a side elevation view of the base portion of the spray nozzle of FIG. 4 rotated clockwise (from above) ninety degrees about its vertical axis from its orientation illustrated in FIG. 22.

Referring to FIGS. 4, 8 and 15, a generally cylindrical exterior portion 26 of the spray nozzle 12 has the top side 24 that is viewable by a person from above the turf or ground surface. The under side of the exterior portion 26 mates with a generally cylindrical base portion 28 (FIGS. 4, 8 and 21) of the spray nozzle 12 to define a nozzle orifice 30 (FIG. 5) and a flow path 32 (FIG. 12) leading to the nozzle orifice 30. The base portion 28 has a female threaded segment 28*a* (FIGS. 9 and 12) that screws over the male threaded upper end 18*a* of the riser 18. Four circumferentially spaced notches 33 (FIGS. 8 and 10) formed in the exterior of the base portion 28 may be engaged by a tool for tightening and un-tightening the spray nozzle 12 relative to the riser 18. The base portion 28 also has a pair of curved, tooth-like upstanding projections 34 and 36 (FIG. 25) that extend through corresponding complementary shaped curved apertures 38 and 40 (FIG. 18) in the exterior portion 28. The projections 34 and 36 provide an indication that is readily visible to a person when viewing the top side 24 and that represents a water distribution pattern and/or flow rate of the nozzle orifice 30.

In the case of the spray nozzle 12, the visible indication of flow pattern and/or rate is achieved as a result of a unique two-piece construction. The exterior portion 26 is injection molded of a suitable plastic having a first color, preferably black and having chemical additives to provide ultraviolet (UV) resistance to limit degradation of the plastic and fading of the color otherwise caused by sunlight. The base portion 28 is injection molded of a different suitable plastic having a second contrasting color, such as orange, and also having chemical additives to provide UV resistance. The tips of the projections 34 and 36 thus stand out from the black plastic of the surrounding exterior portion 26 and their contrasting color will not wear away or fade substantially due to sunlight. The color of the projections 34 and 36 is uniquely associated with a particular water distribution pattern such as one-half circle. It may also be associated with a particular flow rate or radius.

Figure 16:
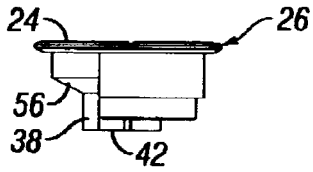
FIG. 16 is a side elevation view of the exterior portion of the spray nozzle of FIG. 4.
Figure 17:
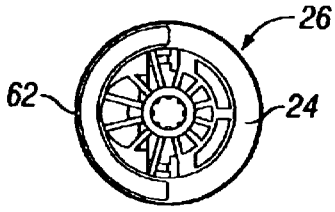
FIG. 17 is a top plan view of the exterior portion of the spray nozzle of FIG. 4.
Figure 23:
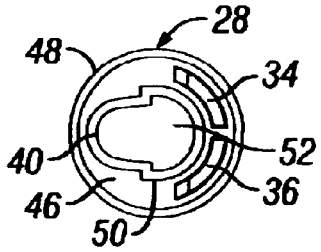
FIG. 23 is a top plan view of the base portion of the spray nozzle of FIG. 4.
Figure 24:
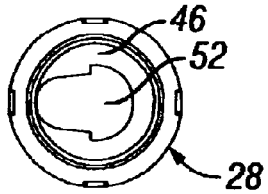
FIG. 24 is a bottom plan view of the base portion of the spray nozzle of FIG. 4.

An improved water distribution pattern is achieved as a result of the unique construction of the nozzle orifice 30 and its associated flow path 32 without the spikes and voids normally associated with conventional spray nozzle orifices. The improved nozzle orifice 30 is intended for less than full circle water distribution patterns such as one-quarter circle, one-half circle and so forth. The exterior portion 26 of the spray nozzle 12 defines an inner arc section 38 (FIG. 16) of the nozzle orifice 30 and the base portion 28 of the spray nozzle 12 defines an outer arc section 40 (FIG. 23) of the nozzle orifice 30. The inner arc section 38 is radially spaced from the outer arc section 40.

The exterior portion 26 includes a downwardly extending sleeve 42 (FIG. 9) that defines a portion of the flow path 32. A metal throttling screw 44 self-threads into a central bore 45 through the sleeve 42 and extends into the water flow path 32. The slotted upper end 44*a* (FIG. 8) of the screw 44 and can be turned with a flat head screw driver to raise and lower a rounded head 44*b* (FIG. 9) on the lower end of the screw 44 to thereby move the same upwards and downwards. The head 44*b* moves up and down within a flared upper end 22*a* (FIG. 2) of the grit strainer 22 to vary the amount of obstruction of the water flow path 30 to thereby adjust the flow rate through the nozzle orifice 30.

The base portion 28 has a horizontal ring 46 (FIG. 23) that is vertically recessed from an outer upper edge of the of the base portion 28 which is provided by a cylindrical wall 48. The curved projections 34 and 36 are integrally formed, with and extend upwardly from, the ring 46. A key-hole shaped wall 50 is formed in the center of the ring 46 and surrounds a key-hole shaped hole 52 in the ring 46. The key-hole shaped hole 52 has a shape that is complementary to the outer shape of the sleeve 42 (FIG. 18) which is snugly received in the hole 52. The smaller diameter segment of the key-hole shaped wall 50 provides the outer arc section 40 of the nozzle orifice 30.

Figure 7:
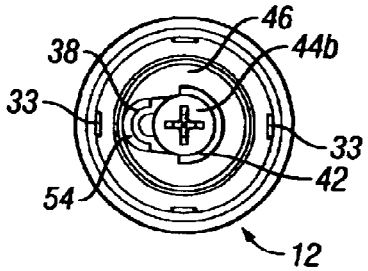
FIG. 7 is a bottom plan view of the spray nozzle of FIG. 4.
Figure 9:
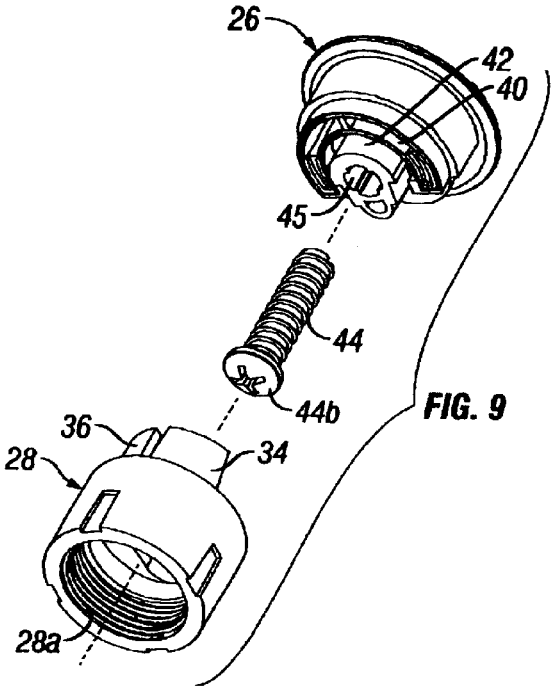
FIG. 9 is an exploded perspective view of the spray nozzle of FIG. 4 taken from below.
Figure 10:
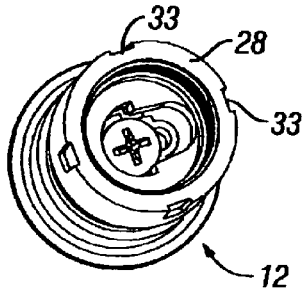
FIG. 10 is a perspective view of the underside of the spray nozzle of FIG. 4.
Figure 11:
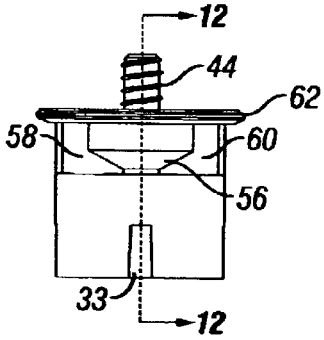
FIG. 11 is another side elevation view of the spray nozzle rotated counter-clockwise (from above) ninety degrees about its vertical axis from its orientation illustrated in FIG. 5.
Figure 19:
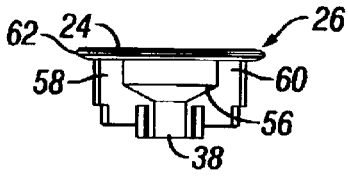
FIG. 19 is a side elevation view of the exterior portion of the spray nozzle of FIG. 4 rotated counter-clockwise (from above) ninety degrees about its vertical axis from its orientation illustrated in FIG. 16.
Figure 20:
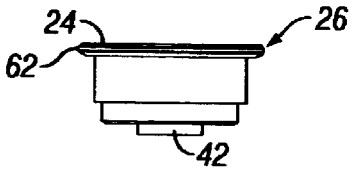
FIG. 20 is a side elevation view of the exterior portion of the spray nozzle of FIG. 4 rotated clockwise (from above) ninety degrees about its vertical axis from its orientation illustrated in FIG. 16.

Referring to FIGS. 9 and 19, the inner arc section 38 forms a portion of the exterior wall of the sleeve 42. When the exterior portion 26 is mated with the base portion 28 a one-hundred eighty degree C-shaped gap 54 (FIG. 7) is defined between the inner arc section 38 and the portion of the ring 46 defining the smaller diameter segment of the key-hole shaped hole 52. The gap 54 forms an intermediate part of the flow path 32. Water flowing through the gap 54 impinges upon the inner arc section 38, a conical under side surface 56 (FIG. 19) of the exterior portion 26 and the outer arc section 40. The conical under side surface 56 extends approximately one hundred and eighty degrees. A segment of the cylindrical wall 48 located radially outward from the outer arc section 40 is located directly beneath the outer periphery of the conical under side surface 56. The exterior portion 26 of the spray nozzle 12 is also formed with a pair of vertical planar lateral walls 58 and 60 (FIG. 19) which extend radially outwardly, at roughly one hundred and eighty degrees apart on opposite sides of the conical under side surface 56. The lateral walls 58 and 60, along with the cylindrical wall 48, and an upper peripheral flange 62 (FIG. 4) further confine the spray ejected from the nozzle orifice 30 formed by the inner arc section 38 and the outer arc section 40.

The size of the fixed orifice 30 is chosen to provide, for example, one-quarter, one-half and full circle arc of coverage. The size of the fixed orifice can also be selected to deliver a particular flow rate in terms of gallons per minute, although arc size largely determines flow rate. Usually the fixed orifice 30 is sized and configured to provide matched rates of precipitation over a given sector size. For example, a one-quarter circle arc spray nozzle will typically deliver water at half the rate of a one-half circle arc spray nozzle of the same design. The flow rate of the orifice 30 is determined by the radial distance between the inner arc section 38 and the outer arc section 40, and the circumferential length of these sections, which together determine the overall size of the opening for the flow of water out of the spray nozzle 12.

While we have described a preferred embodiment of our invention, those skilled in the irrigation sprinkler art will appreciate that invention may be modified in both arrangement and detail. For example an irrigation spray nozzle can incorporate only the improved visual identifier aspect of our invention, or only the improved nozzle orifice construction, or both. The visual identifier need not be formed by mating parts molded of different color plastics, but instead the any projection that protrudes from the base portion, or some other part of the spray nozzle, through the exterior portion could have a painted tip, a molded flag, a reflector or some other device to provide a visual indication of the water distribution pattern, or flow rate, or both. The projections could extend from some other structural component of the spray nozzle besides the exterior portion or the base portion and could even be separate discrete insertable elements. In addition, this visual identifier could be used in sprinklers besides the spray type, e.g. rotor type sprinklers. Our invention, when embodied in an irrigation spray nozzle, could be used on fixed risers or on telescoping risers in pop-up sprinklers. It is not necessary in order to achieve the benefits our invention that a sprinkler equipped with our new nozzle be provided with a pressure regulator or a grit screen. The base portion could define the inner arc section and the exterior portion could define the outer arc section, which is the converse of the arrangement illustrated and described herein in conjunction with the preferred embodiment. Therefore, the protection afforded our invention should only be limited in accordance with the scope of the following claims.

We claim:

1. An irrigation sprinkler nozzle that allows top-down visual inspection of the water distribution pattern and/or flow rate of its nozzle orifice, comprising:

an exterior portion having a top side; and a base portion that mates with the exterior portion to define a nozzle orifice having a predetermined size and a predetermined configuration and a flow path leading to the nozzle orifice, the base portion having a projection integral and non-coaxial with the base portion that extends through an aperture in the exterior portion and provides an indication that is visible when viewing the top side and that represents a water distribution pattern and/or flow rate of the nozzle orifice.

2. The nozzle of claim 1 wherein the base portion has a generally cylindrical configuration.

3. The nozzle of claim 2 wherein the base portion is threaded for screwing over an upper end of a riser.

4. The nozzle of claim 1 wherein the exterior portion is made of a plastic of a first color and the projection is made of a plastic of a second color to provide the indication.

5. The nozzle of claim 1 wherein the exterior portion defines an inner arc section of the nozzle orifice and the base portion defines an outer arc section of the nozzle orifice that is radially spaced from the inner arc section.

6. The nozzle of claim 1 wherein the exterior portion includes a downwardly extending sleeve that defines a portion of the flow path.

7. The nozzle of claim 6 further comprising a throttling screw that threads into a bore in the sleeve and extends into the flow path for adjusting the flow rate through the nozzle orifice.

8. The nozzle of claim 1 wherein the base portion has a pair of projections that extend through corresponding apertures in the exterior portion and have a first color different from a second color of the exterior portion to provide the indication that is visible when viewing the top side and that represents a water distribution pattern and/or flow rate of the nozzle orifice.

9. The nozzle of claim 2 wherein the generally cylindrical base portion has a horizontal ring recessed from an upper edge of the of the base portion and from which the projection extends.

10. The nozzle of claim 9 wherein the generally cylindrical base portion has a cylindrical wall that forms a lower peripheral lip of the nozzle orifice.

11. An irrigation sprinkler nozzle, comprising:

an exterior portion having a top side;

a base portion that mates with the exterior portion to define a nozzle orifice having a predetermined size and a predetermined configuration and a flow path leading to the nozzle orifice, the base portion having a projection integral and non-coaxial with the base portion that extends through an aperture in the exterior portion and provides an indication that is visible when viewing the top side and that represents a water distribution pattern and/or flow rate of the nozzle orifice; and the exterior portion defining an inner arc section of the nozzle orifice and the base portion defining an outer arc section of the nozzle orifice that is radially spaced from the inner arc section.

* * * * *